US006397633B1

(12) United States Patent
Wu

(10) Patent No.: US 6,397,633 B1
(45) Date of Patent: Jun. 4, 2002

(54) DECORATIVE COSMETIC CASE

(75) Inventor: Shang-Wu Wu, Tainan (TW)

(73) Assignee: Hong Yi Cosmetics Co., Ltd., Tainan (TW)

( * ) Notice: Subject to any disclaimer, the term of this patent is extended or adjusted under 35 U.S.C. 154(b) by 0 days.

(21) Appl. No.: 09/391,075

(22) Filed: Sep. 4, 1999

(51) Int. Cl.[7] ..... A44C 13/00
(52) U.S. Cl. ..... 63/1.11; 63/1.14; 63/15
(58) Field of Search ..... 206/6.1, 581; 63/1.11, 63/1.14, 15, 40

(56) References Cited

U.S. PATENT DOCUMENTS 1,383,104 A * 6/1921 Grossman
6,000,547 A * 6/1921 Ovadia et al. ..... 206/6.1
1,623,994 A * 4/1927 Buchsbaum et al.
1,743,563 A * 1/1930 Montuori
1,752,719 A * 4/1930 Baum
1,861,644 A * 6/1932 Roberts
2,605,032 A * 7/1952 Hunt et al.
3,559,854 A * 2/1971 Loveland
4,915,234 A * 4/1990 Boeller
5,056,660 A * 10/1991 Huang
5,115,648 A * 5/1992 Salvucci ..... 63/15
5,732,862 A * 3/1998 Bull ..... 63/15

* cited by examiner

*Primary Examiner*—David T. Fidei
(74) *Attorney, Agent, or Firm*—Pro-Techtor International Services

(57) ABSTRACT

A decorative cosmetic case includes at least one or more cosmetic cases, and a decorative worn on a finger of a user for assembled with the cosmetic case(s). The decorative has a flat base on top, and the cosmetic case is made of transparent material, having an interior cavity for containing a cosmetic and a recess formed in the bottom for the flat base of the decorative to fit firmly therein, and an outer circumferential edge on an upper side to fit in the recess of the bottom of another cosmetic case. Then one or more of the cosmetic cases may be assembled on the decorative, with the flat base of the decorative fitting firmly in the recess of the cosmetic case. Thus different cosmetic cases with colored cosmetics may be selected to be carried out for convenience of use.

3 Claims, 7 Drawing Sheets

DECORATIVE COSMETIC CASE

BACKGROUND OF THE INVENTION

This invention relates to a decorative cosmetic case, particularly to one changeable according to need in selecting colors of cosmetics, and able to be carried with ease by assembled on a decorative such as a ring worn on a finger of a user.

Traditional cosmetics are packaged in different cases, independent from each other, inconvenient to carry out, so various cosmetic cases are designed and available on market, having small recesses for containing lipsticks, eye shadows, pressed powders, etc.

Such conventional cosmetic cases with plural recesses practically contains only small volume of cosmetics, always the same colored, unchangeable according to need. If other colored cosmetics are needed, then a user has to get another cosmetic case.

SUMMARY OF THE INVENTION

This invention has been devised to offer a decorative cosmetic case having one or more cosmetic cases assembled on a decorative such as a ring worn on a finger of a user so that the cosmetic case is convenient to be carried out, and in addition, a user can select different cosmetic cases to be assembled with the decorative to change colored cosmetics if needed.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
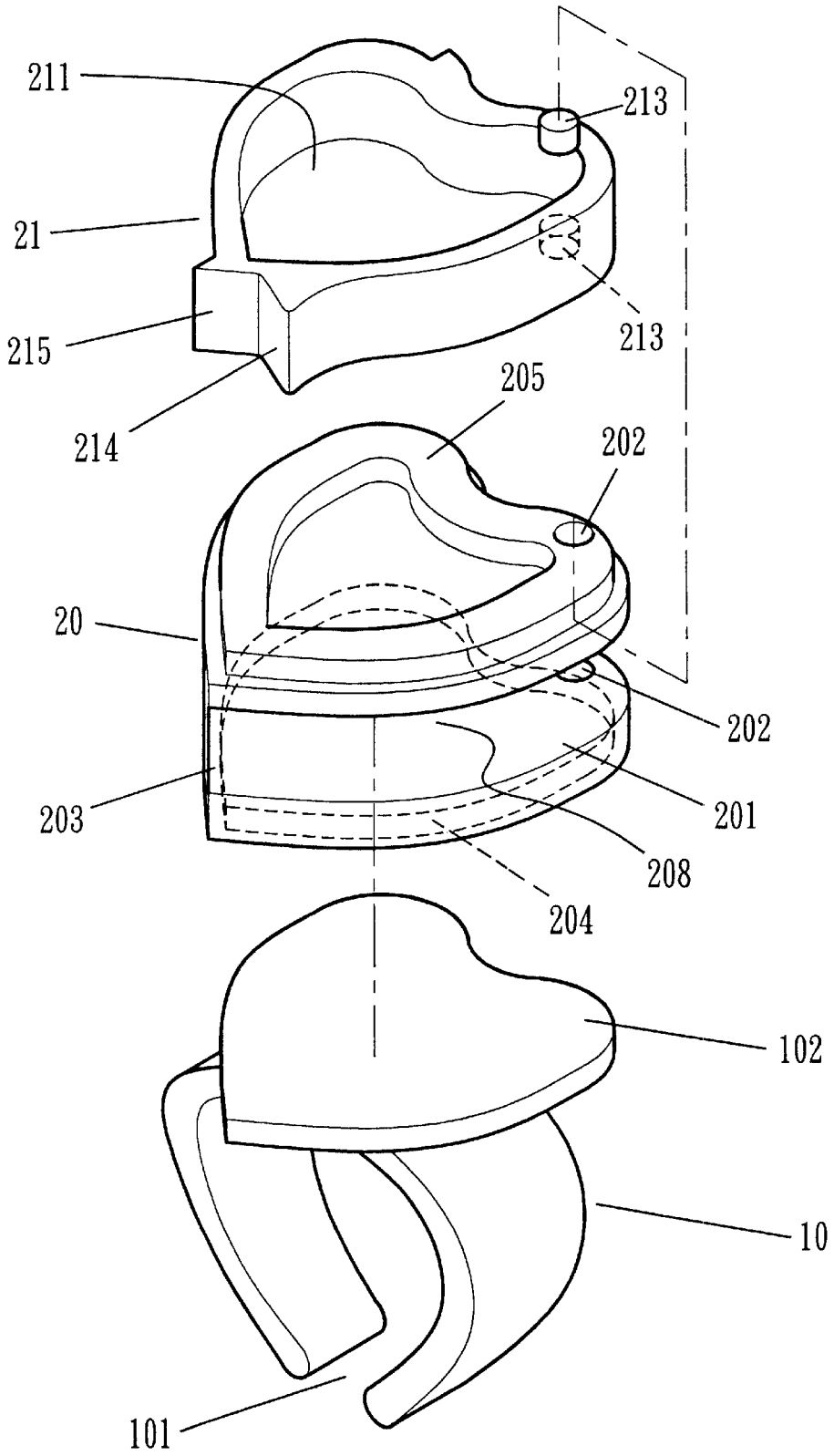
FIG. 1 is an exploded perspective view of a first embodiment of a decorative cosmetic case in the present invention.

A first embodiment of a decorative cosmetic case in the present invention, as shown in FIGS. 1, includes one or more cosmetic cases 20, and a decorative 10 (for example, a ring illustrated in Figures) worn on a finger of a user.

The decorative 10 is a ring with an opening 201 formed in a bottom so as to let it adjustable in worn on a finger of a user, having a flat base 102 formed on top and having the same shape as the cosmetic case 20.

The cosmetic case 20 is made of transparent material, having an opening 201 formed in an intermediate portion of a circumferential wall 203, a ⊏-shaped cavity 208 defined by the circumferential wall, a pivot hole 202 respectively in an upper wall and a lower wall near one end of the opening 201, a cosmetic plate 21 having the same shape of the cosmetic case 20 and a center recess 211 for receiving a cosmetic 212 such as lipstick, eye shadow, or a pressed powder therein and able to be swung in and out of the cavity 208 by means a pivot 213 respectively formed on and under the plate body 21 fitting in the pivot holes 202. The cosmetic plate 21 further has a V-shaped push projection 214 formed on an outer surface of the circumferential wall to protrude out of the cavity 208, and another V-shaped projection 215 formed near the push projection 214.

Figure 2:
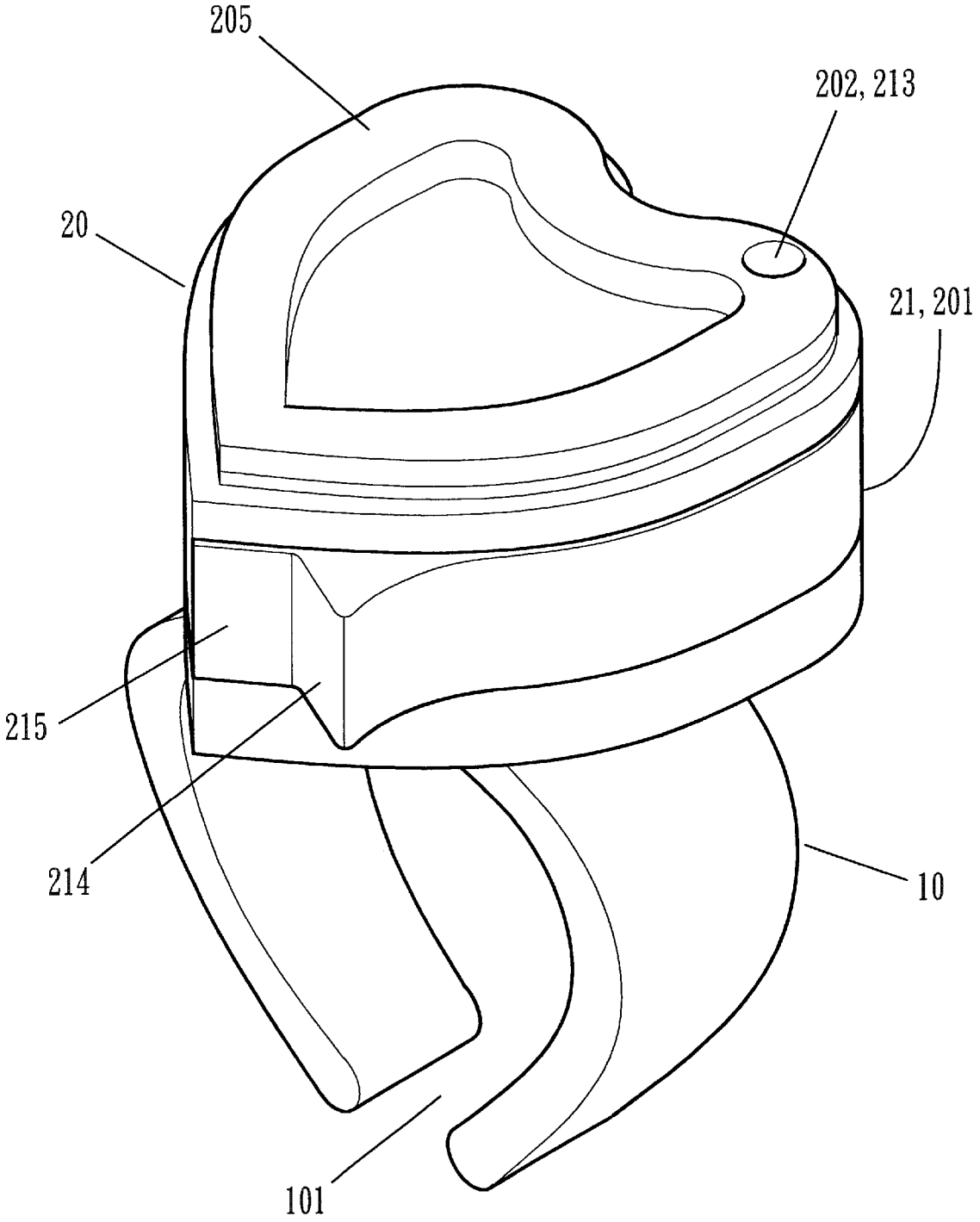
FIG. 2 is a perspective view of the first embodiment of a decorative cosmetic case in the present invention.
Figure 4:
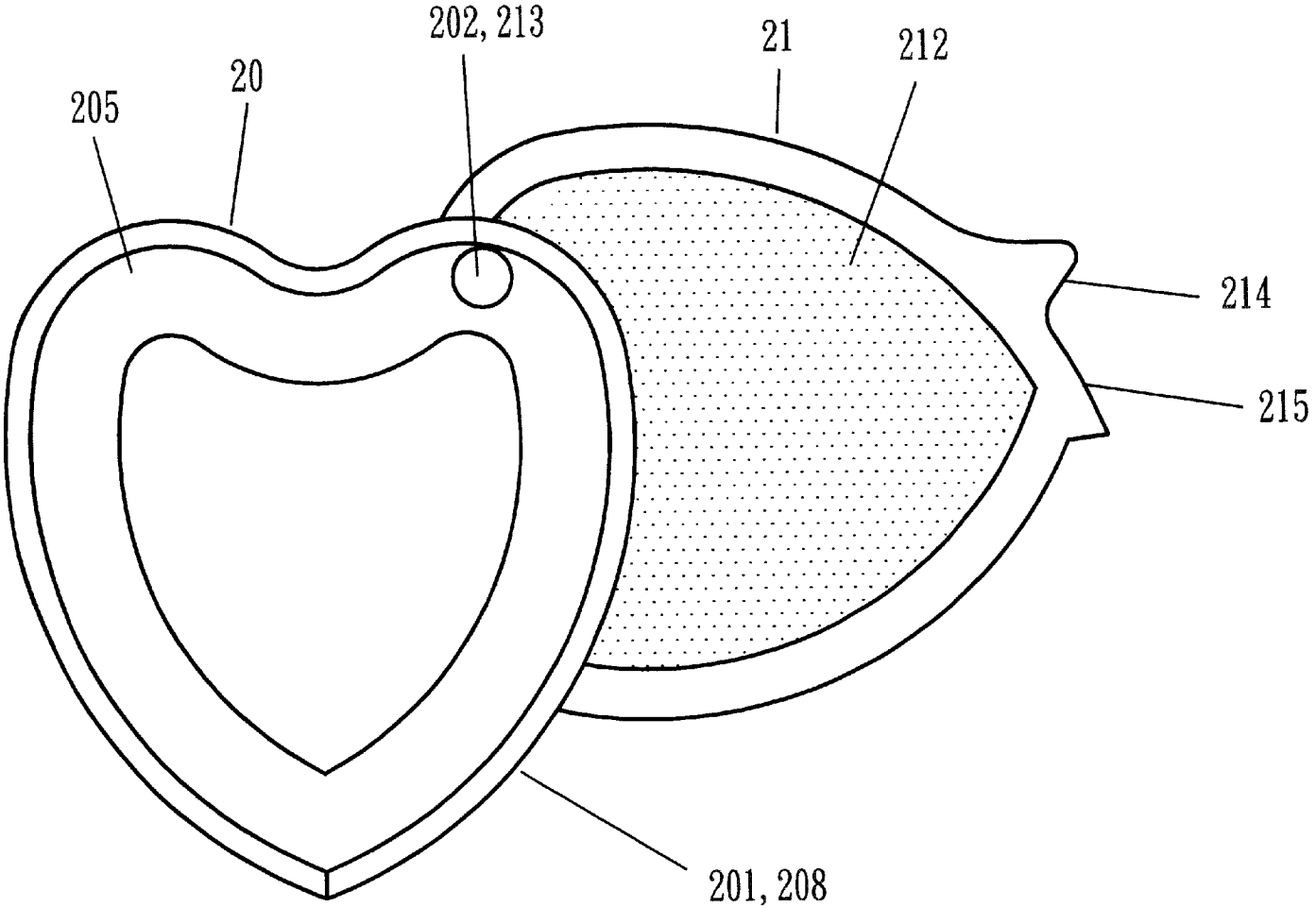
FIG. 4 is an upper view of a cosmetic plate swung out of the first embodiment of a decorative cosmetic case in the present invention.

The cosmetic plate 21 is pushed through the opening 201 and inserted in the cavity 208 of the cosmetic case 20 normally, with the pivots 213 inserted in the pivot holes 202 and functioning to let the cosmetic plate 21 swing out of and in the cavity 208. If the cosmetic plate 21 is pushed at the push projection 214 with the pivots 213, it swings out of the cavity to let the cosmetic 212 exposed as shown in FIG. 4 for the user to use it. On the contrary, if the cosmetic plate 21 is pushed at the push projection 214 to swing in the cavity 208, the end of the circumferential wall 203 stops the V-shaped projection 215 of the cosmetic plate 21 as shown in FIG. 2, with the push projection 214 exposed out. The bottom of the cosmetic case 20 has a recess 204 for the base 102 of the decorative to fit tightly therein and a circumferential projecting-up edge 205 formed on an upper side to fit in the recess 204 of another cosmetic case 20 if two cosmetic cases 20 are combined at the same time with the decorative 10.

Figure 3:
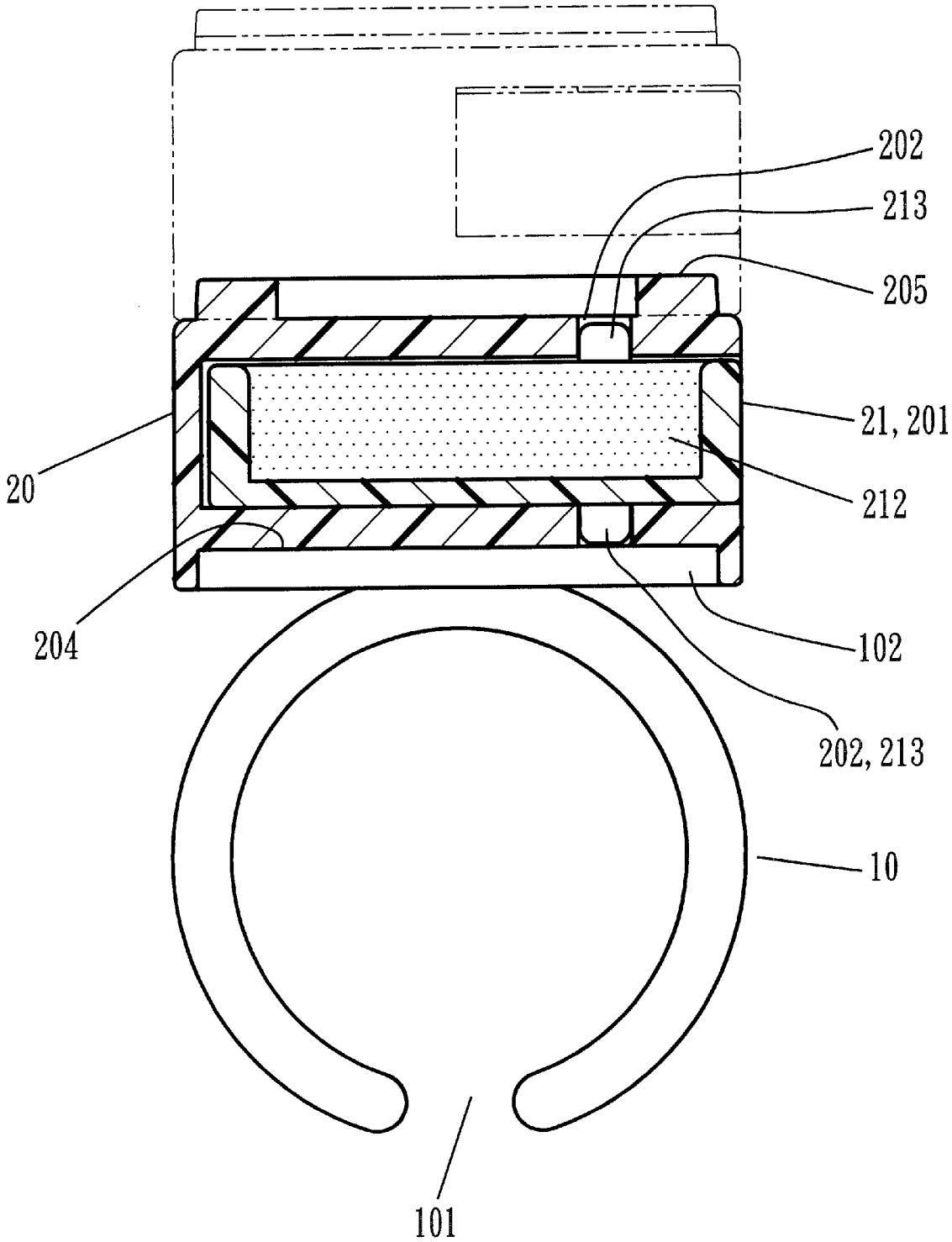
FIG. 3 is a cross-sectional view of FIG. 2.
Figure 5:
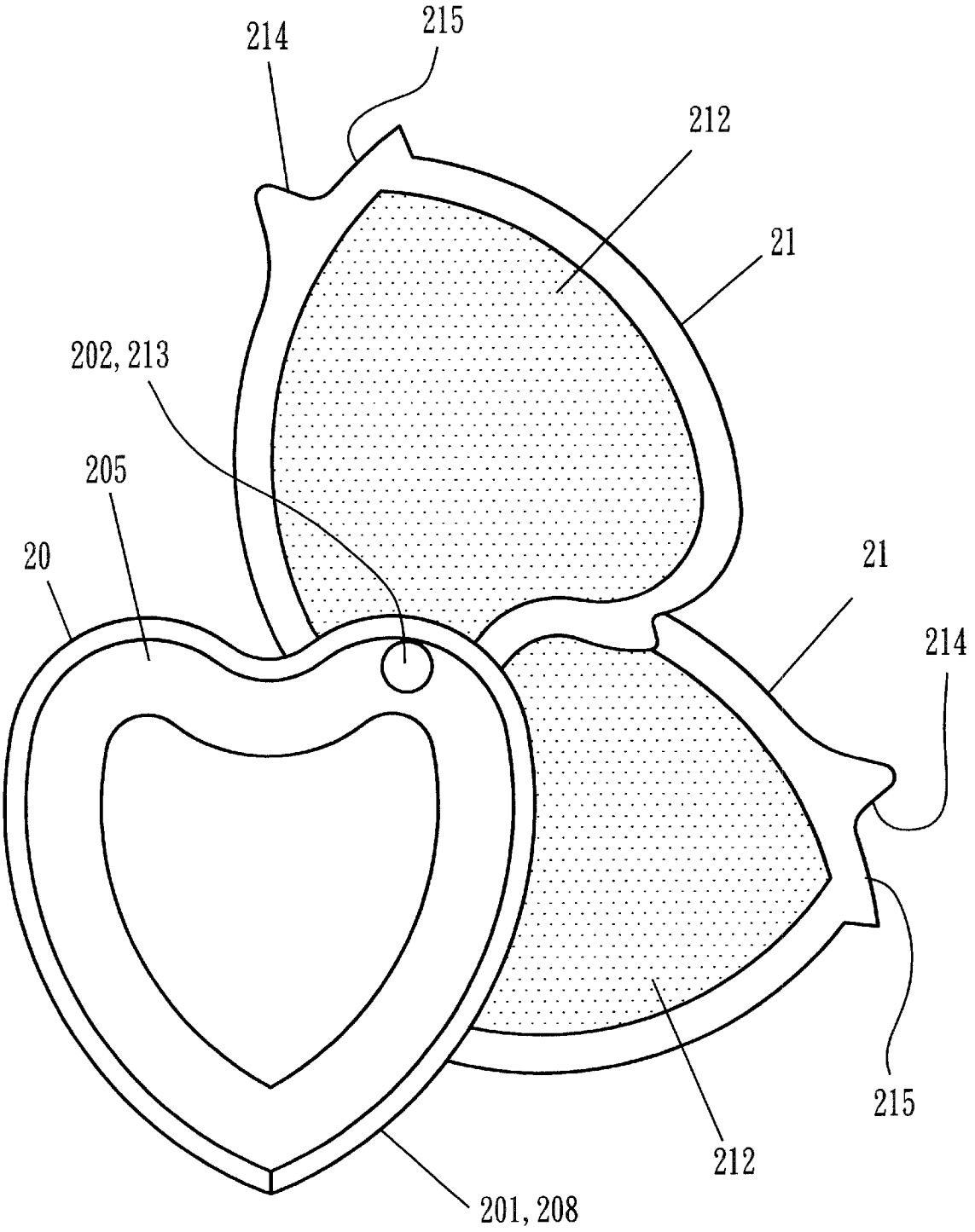
FIG. 5 is an upper view of two cosmetic plates swung out of the first embodiment of a decorative cosmetic case in the present invention.

In assembling, as shown in FIGS. 2 and 3, the base 102 of the decorative 20 is directly fitted in the recess 204 of the cosmetic case 20. The characteristic of this invention is that a user can select the cosmetic cases 20 containing lipstick, eye shadow or a pressed powder to be assembled with the decorative 10 according to the user's need to be carried out. If two or more cosmetic cases 20 are needed, they can be assembled together by means of the projecting edge 205 engaging the recess 204 as shown in FIGS. 3 or 5. Thus two or more different cosmetics may be carried out for use. It is convenient to carry, as the decorative 10 is worn on a finger of a user, and the cosmetic case(s) 20 are assembled on the decorative, with the colors of the cosmetics visible through the transparent case(s) 20 as decorative effect.

Figure 6:
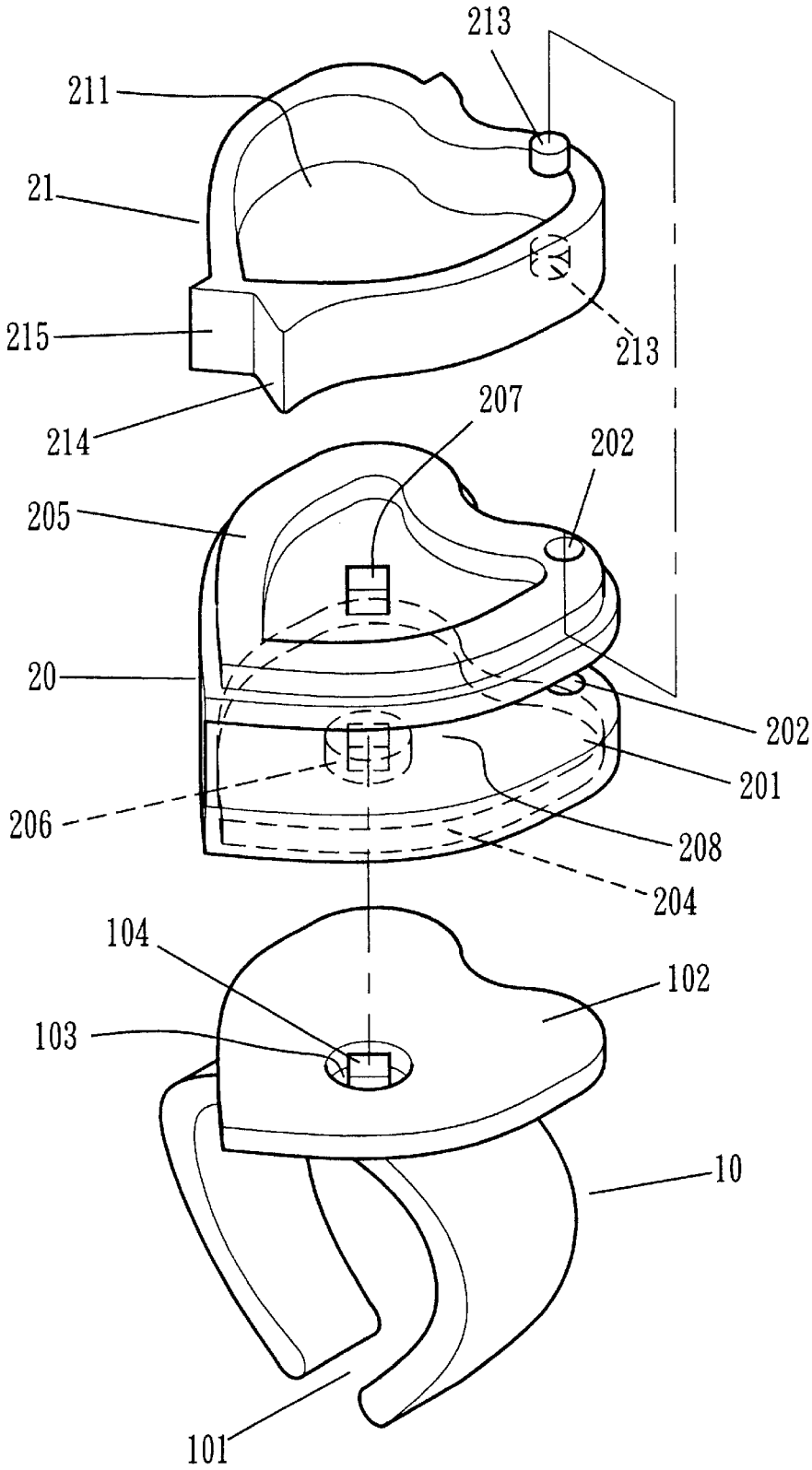
FIG. 6 is an exploded perspective view of a second embodiment of a decorative cosmetic case in the present invention; and, FIG. 7 is a cross-sectional view of the second embodiment of a decorative cosmetic case in the present invention.
Figure 7:
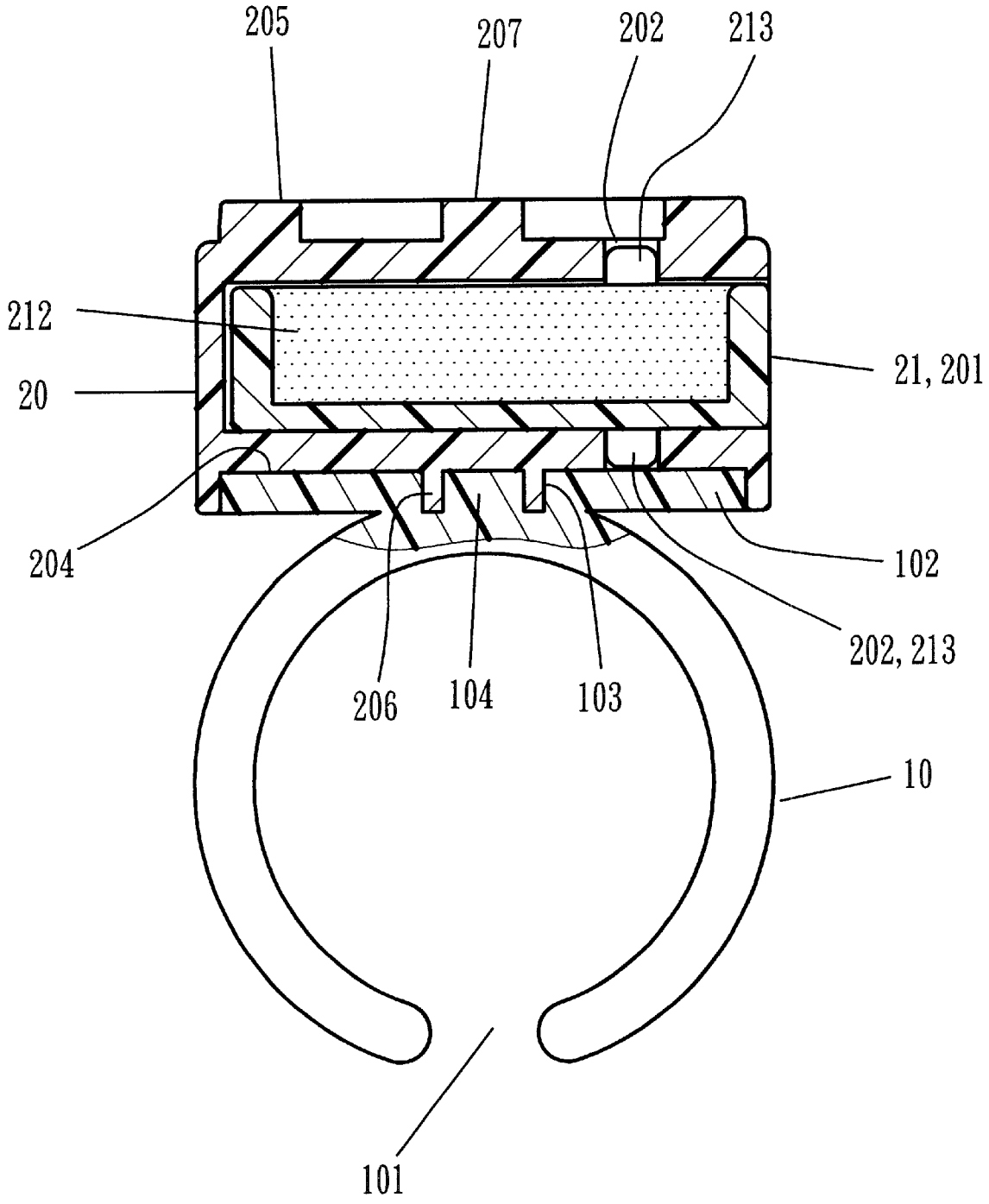

A second embodiment of a decorative cosmetic case is shown in FIGS. 6 and 7, also includes a decorative 10 and one or more cosmetic cases 20 combined together. The difference is the base 102 of the decorative 10 further has a center round groove 103, and a post 104 formed in the center round groove 103 and having the same height as the thickness of the base 102. The cosmetic case 20 20 further has a hole 206 formed in the center of the bottom for the post 104 to fit therein, and a post 207 formed on an upper wall to fit in the hole 206 of another cosmetic case 20 so as to permit two or more cosmetic cases 20 assembled together in case of need.

The cosmetic base 20 can also be made to have an inner hollow with an upper cap pivotally connected to an upper side of the base body, with a cosmetic directly contained in the inner hollow, and a recess 204 or a center hole 206 for a projecting edge 205 or a post 207 formed on top of the upper cap of another cosmetic case 20 to engage so as to form two or more layers of the cosmetic cases 20.

A user may select cosmetics of different colors contained in different cosmetic cases 20 assembled with the decorative 10 everyday to carry out so as to be conveniently used in case of supplementary need.

While the preferred embodiments of the invention have been described above, it will be recognized and understood that various modifications may be made therein and the appended claims are intended to cover all such modifications which may fall within the spirit and scope of the invention.

I claim:

1. A decorative case comprising:

at least one case element and a piece of decorative jewelry adapted to be worn on a finger of a user;

said piece of decorative jewelry includes an upper surface which forms a mounting base, said at least one case element includes an inner cavity adapted to contain a cosmetic, a lower surface of said at least one case element includes a recess to receive an upper end of said mounting base, said recess of said at least one case element having a shape matching that of said base element, an upper surface of said at least one case element includes a projection with a shape matching that of said base element, said projection being adapted to receive a second unit of said at least one case element such that more than one case element may be stacked together; wherein said at least one case element is secured on said base element by pressing said at least one case element onto said base element such that said base element is received in said recess of said at least one case element.

2. The decorative case as defined in claim 1 wherein:

said base element includes a securing recess in said upper surface thereof, and said at least one case element includes a securing projection extending from said lower surface, said securing recess has a shape conforming to that of said securing projection; such that said at least one case element is further secured on said base element by said securing projection being received in said securing recess.

3. The decorative case as defined in claim 1 wherein:

said at least one case element includes an opening in an outer wall, said opening provides access to an interior cavity of said at least one case element, said interior cavity includes a mounting means, and at least one cosmetic plate is received in said interior cavity, said at least one cosmetic plate includes mounting means thereon that mates with said mounting means of said at least one case element, so that said at least one cosmetic plate is pivotally mounted in said interior cavity, said at least one cosmetic plate includes a push projection on an outer surface thereof, said push projection enabling a user to easily move said at least one cosmetic plate from a first position where an interior of said at least one cosmetic plate is covered by said at least one case element to a second position where said interior of said at least one cosmetic plate is exposed.

* * * * *